US008786454B2

(12) United States Patent
Siddall

(10) Patent No.: US 8,786,454 B2
(45) Date of Patent: Jul. 22, 2014

(54) AIR FLOW SENSOR

(75) Inventor: John Siddall, Leland, MI (US)

(73) Assignee: World Magnetics Company, Traverse City, MI (US)

( * ) Notice: Subject to any disclaimer, the term of this patent is extended or adjusted under 35 U.S.C. 154(b) by 985 days.

(21) Appl. No.: 12/543,799

(22) Filed: Aug. 19, 2009

(65) Prior Publication Data

US 2010/0045472 A1 Feb. 25, 2010

Related U.S. Application Data

(60) Provisional application No. 61/189,935, filed on Aug. 25, 2008.

(51) Int. Cl.

| | |
|---|---|
| ***G08B 21/00*** | (2006.01) |
| ***D06F 58/22*** | (2006.01) |
| ***D06F 58/28*** | (2006.01) |

(52) U.S. Cl.

CPC ..... *D06F 58/28* (2013.01); *D06F 58/22* (2013.01); *D06F 2058/2858* (2013.01)

USPC ..... 340/626; 73/700; 34/88; 34/558

(58) Field of Classification Search

USPC ..... 340/603, 626; 73/700; 34/88, 89, 558

See application file for complete search history.

(56) References Cited

U.S. PATENT DOCUMENTS

| | | | | |
|---|---|---|---|---|
| 2,577,104 | A | 12/1951 | Butler | |
| 2,941,308 | A | 6/1960 | Cobb et al. | |
| 3,286,508 | A | 11/1966 | Spiegel | |
| 3,639,998 | A | 2/1972 | Mason | |
| 3,718,982 | A | 3/1973 | Deaton | |
| 3,999,440 | A * | 12/1976 | Kain | 73/431 |
| 4,700,492 | A * | 10/1987 | Werner et al. | 34/403 |
| 5,097,606 | A | 3/1992 | Harmelink et al. | |
| 6,220,092 | B1 | 4/2001 | Catbagan | |
| 6,328,647 | B1 * | 12/2001 | Traudt | 454/255 |
| 6,587,767 | B2 * | 7/2003 | Letang et al. | 701/34.4 |
| 6,637,127 | B2 | 10/2003 | Reede et al. | |
| 6,655,047 | B2 * | 12/2003 | Miller, II | 34/544 |
| 6,785,981 | B1 | 9/2004 | Harpenau | |
| 7,237,298 | B2 * | 7/2007 | Reindle et al. | 15/319 |
| 8,061,058 | B2 * | 11/2011 | Harpenau | 34/558 |

* cited by examiner

*Primary Examiner* — George Bugg
*Assistant Examiner* — Edny Labbees
(74) *Attorney, Agent, or Firm* — Honigman Miller Schwartz and Cohn LLP

(57) ABSTRACT

A device for identifying the air flow condition within a clothes dryer having a lint filter, an exhaust passage, and a blower is disclosed. The device includes a sensor, an input having a first end connected to the sensor and a free second end, wherein the free second end is adapted to be disposed within the clothes dryer, upstream from a filter, and wherein the sensor detects a differential between an operating pressure at the free second end of input versus a reference pressure to thereby determine whether a sufficient vacuum is present within the clothes dryer, and an output that provides an output characteristic based on the differential, wherein the output characteristic changes from a first characteristic to a second characteristic when the differential surpasses a differential threshold.

18 Claims, 1 Drawing Sheet

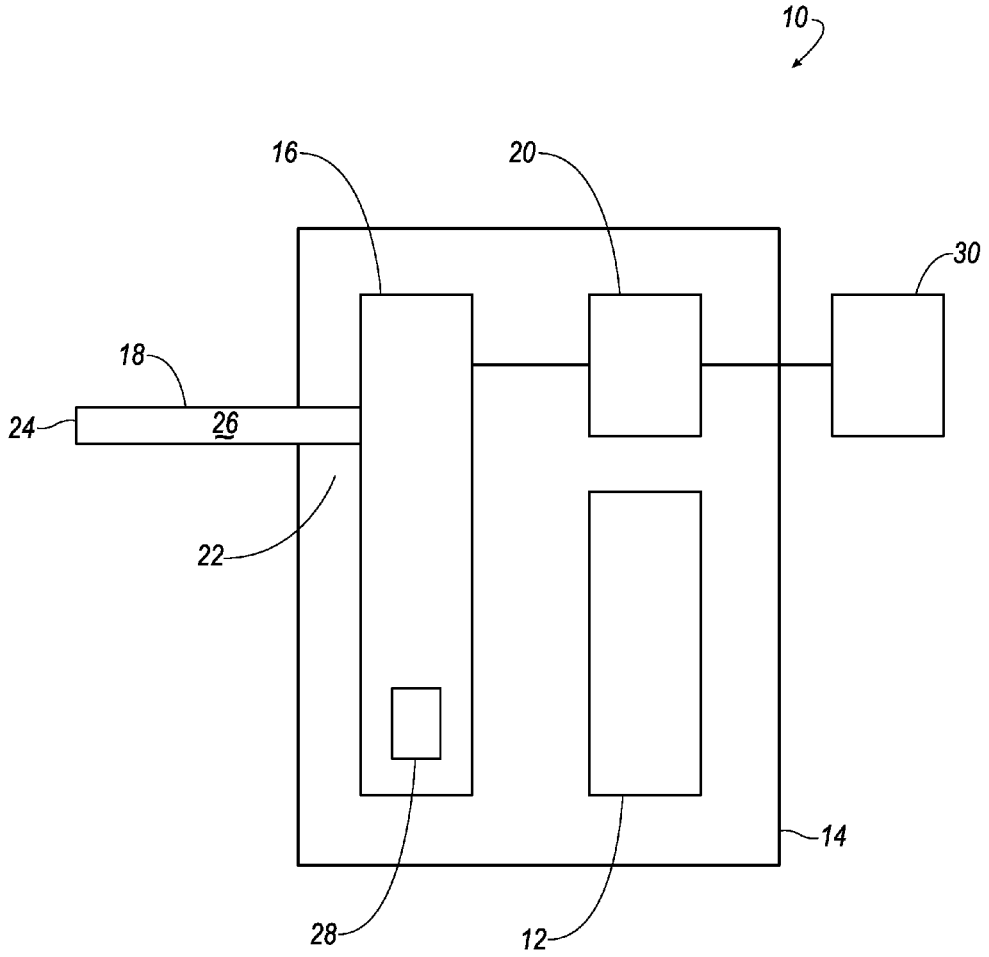
10
16
20
30
18
24
26
22
14
28
12

AIR FLOW SENSOR

RELATED APPLICATION

This application claims priority under 35 U.S.C. §119(e) to the U.S. Provisional Patent Application No. 61/189,935 filed on Aug. 25, 2008, the contents of which are fully incorporated herein by reference.

BACKGROUND

A device for identifying the air flow condition within a clothes dryer having a lint filter, an exhaust passage, and a blower is disclosed. The device includes a sensor, an input having a first end connected to the sensor and a free second end, wherein the free second end is adapted to be disposed within the clothes dryer, upstream from a filter, and wherein the sensor detects a differential between an operating pressure at the free second end of input versus a reference pressure to thereby determine whether a sufficient vacuum is present within the clothes dryer, and an output that provides an output characteristic based on the differential, wherein the output characteristic changes from a first characteristic to a second characteristic when the differential surpasses a differential threshold.

SUMMARY

A device for identifying the air flow condition within a clothes dryer is disclosed. The device comprises a sensor, an input having a first end connected to the sensor and a free second end, wherein the free second end is adapted to be disposed within a clothes dryer, upstream from a filter, and wherein the pressure sensor detects a differential between an operating pressure at the free second end of input versus a second pressure, and an output that provides an output characteristic based on the differential, wherein the output characteristic changes from a first characteristic to a second characteristic when the differential surpasses a differential threshold.

Upon further study of the specification and appended claims, further features and advantages of this invention will become apparent to those skilled in the art.

BRIEF DESCRIPTION OF THE DRAWINGS

The disclosure will now be described, by way of example, with reference to the accompanying drawings, in which:

FIG. 1 is a diagrammatic representation of an air flow detection unit in accordance with an exemplary embodiment of the invention.

DETAILED DESCRIPTION

FIG. 1 depicts an exemplary embodiment of an airflow sensing unit ("unit"). For purposes of this disclosure, it is to be generally understood that the nomenclature used herein is simply for convenience and the terms used to describe the invention should be given the broadest meaning by one of ordinary skill in the art. It is also to be understood that the specific device illustrated in the attached drawing, and described in the following specification are simply exemplary embodiments of the inventive concepts. Specific dimensions and other physical characteristics relating to the embodiments disclosed herein are not to be considered as limiting, unless expressly stated otherwise.

In an embodiment, unit is adapted to detect the absence or presence of a vacuum within a device such as a clothes dryer, a furnace or a similar device ("device"). In an embodiment, unit is adapted to identify whether the exhaust passage therewithin is properly arranged, unimpeded and the like and whether a blower that may be situated downstream from the unit sufficiently evacuates air from within the device. While the remainder of this disclosure refers to device as a clothes dryer, it is to be appreciated that the disclosed unit may be used in connection with any device having such an exhaust passage and the application and beneficial uses of the invention should not be so limited to a clothes dryer.

Referring now to FIG. 1, unit is illustrated at 10. In an embodiment, unit 10 includes a power supply 12, a sensor 16, an input 18 and an output 20. In an embodiment, unit 10 includes a housing 14 but it is to be appreciated that housing 14 may be omitted and the invention should not be limited to the disclosed embodiment.

In an embodiment, input 18 is a tubular member having a first end 22 that is connected to sensor 16 and a free, second end 24. In an embodiment, input 18 defines an pathway 26 between first end 22 and sensor 16. It is to be appreciated that while input 18 is described as being a tubular member, this description is for illustrative purposes only and other suitable structure may be implemented to connect sensor 16 to input 18 and the invention should not be so limited thereby. Also, in an embodiment, tubular member may be retractably connected to housing 14 and sensor 16 such that a majority portion of tubular member is contained within housing 14 when unit 10 is not being used and can be extended therefrom into a working position as desired. In an embodiment, tubular member is a flexible plastic tube and is adapted to extend through a closed dryer door without materially affecting the operation of the dryer.

In an embodiment, sensor 16 includes a switch 28. In an embodiment, switch 28 is a normally open pressure vacuum differential switch such that when input 18 is inserted within the clothes dryer upstream from a blower, sensor 16 can identify whether a sufficient vacuum exists within the clothes dryer such that the proper evacuation of air occurs. In an embodiment, the detection of such a vacuum is facilitated by comparing the pressure within the clothes dryer with a reference pressure. In an embodiment, reference pressure may be the environmental pressure of the area outside of the clothes dryer. The use of an normally opened switch facilitates the detection of a vacuum as the airflow within the unit will urge the open pressure switch into a closed position. In another embodiment, switch may instead compare the pressure within the clothes dryer with a different reference pressure.

In an embodiment, switch 28 is connected to a circuit such that the closing thereof alters a characteristic of output 20. For brevity, this disclosure will exemplify the operation of the unit using a normally open switch but it is to be understood that the equivalent method of operation could be facilitated using a normally closed switch. In addition, it is to be understood that a dynamic sensing device could be used in connection with sensor 16 rather than the exemplarily disclosed switch. For example and among others, sensor 16 could measure the pressure differential in real time or within specified intervals and output same. In another embodiment, sensor may include multiple switches, dynamic measurement units to identify multiple characteristics within the device. These and other sensing feature should become apparent after considering this disclosure.

In an embodiment, switch 28 is calibrated to close when the differential exhibited within the clothes dryer, upstream from the lint trap and blower, if any, versus the reference pressure surpasses a pre-defined differential threshold as such will identify the vacuum condition within the clothes dryer.

In an embodiment, output 20 may include one or more light sources to indicate the condition of switch 28 and the associated circuit to which output 20 is connected. In an embodiment, output 20 includes two light emitting diodes ("LEDs"). In an embodiment, a first one of two LEDs emits a first light when the pressure condition within passage 26 is maintained below the threshold pressure and a second of two LEDs emits a second light when the pressure condition within passage 26 exceeds the threshold differential. After considering this disclosure, it will be readily apparent to one of ordinary skill in the art that any combination of LED's may be used to signal the condition of the pressure within passage 26. For example, one LED may emit light upon a first pressure condition and both LEDs may emit light based on a second condition. Alternatively, one LED may be employed such that it only emits light when the pressure switch detects a rise in pressure or vice versa.

In an embodiment, output 20 may alternatively, or additionally, be connected to, or include, an alarm 30 to signal the pressure condition within passage 26. In an embodiment, alarm 30 may exhibit an audible signal when the differential exceeds the threshold as discussed above. In an embodiment, alarm 30 may be a selected from the group consisting of a smoke alarm, a fire alarm a carbon monoxide detector or the like. In an embodiment, alarm 30 may be any type of device such as a cell phone, computer, email account or the like. In an embodiment, alarm 30 may be connected to a third party service provider such as a security company, a fire station, a police station or the like. In an embodiment, alarm 30 may be any combination of the foregoing.

Now that exemplary embodiments of unit 10 have been described in a manner as to apprise one of ordinary skill in the art how to make and carry out the unit, a method of operating the unit will be described. As described above, unit 10 can be used in connection with a clothes dryer. Unit 10 can be permanently installed in connection with a clothes dryer, or alternatively, unit 10 can be portable to facilitate testing on multiple units. In an embodiment and to facilitate operation, second end of tubular member of input 18 is inserted within the clothes dryer, upstream from the lint trap and the blower. Positioning second end of tubular member downstream of input 18 will decrease the efficacy of the results as the lint can provide, or supplement, the impendence of passage and the inventor hereof has realized higher accuracy by testing the passage upstream of the lint trap. In addition, due to the location of unit at an upstream position and because it is detecting the presence or absence of a vacuum, lint and other material do not enter the switch and will not impede input.

Accordingly, sensor 16 can thereby determine whether the pressure differential within the inside of the dryer is sufficient when the dryer is turned on. Depending on the condition of sensor 16, an output is provided to alert whether the differential between the pressure within the dryer and the environmental pressure is sufficient. As set forth above, the output may be provided via LEDs, an audible alarm, a signal to a third party service provider or any combination of the foregoing.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A device for identifying an air flow condition within a plurality of clothes dryers, each having: a door, a lint filter and a blower, the device comprising:

a housing containing a power supply;

a sensor disposed within the housing;

a tubular member having a first end connected to the sensor and a second end that extends beyond an outer surface of the housing, wherein the tubular member defines a passageway extending between the first end and the second end such that the first end is in fluid communication with atmosphere that surrounds the outer surface of the housing, wherein the tubular member is retractably connected to housing and sensor such that a majority portion of tubular member is contained within housing when the device is not being used and can be extended therefrom beyond the outer surface of the housing and into a working position, wherein the tubular member is a flexible plastic tube and is extendable through the door when arranged in a closed orientation without materially affecting the operation of the clothes dryer, wherein the second end of the tubular member is adapted to be disposed within the clothes dryer, upstream from a filter, and wherein the sensor detects a differential between an operating pressure at the free second end of the tubular member versus a reference pressure to thereby determine whether a sufficient vacuum is present within the clothes dryer; and an output that provides an output characteristic when the differential is less than a pre-determined differential threshold, wherein the output characteristic changes from a first characteristic to a second characteristic when the differential surpasses the pre-determined differential threshold, wherein the device is a handheld, portable device that can readily identify the flow condition in a plurality of clothes dryers.

2. The portable test device according to claim 1, further comprising:

a housing, wherein the sensor is disposed within the housing, and wherein the tubular member is a tubular member and the second end of the tubular member extends outside of the housing.

3. The portable test device according to claim 2, wherein the tubular member is retractable such that second end of tubular member extends between a first operating position and a second non-operating position.

4. The portable test device according to claim 1, wherein the sensor includes a device selected from the group consisting of a transducer and a normally open pressure vacuum differential switch.

5. The portable test device according to claim 1, wherein the sensor includes two or more pressure vacuum differential switches to identify more than one vacuum conditions within the clothes dryer.

6. The portable test device according to claim 1, wherein the output includes one or more light emitting diodes.

7. The portable test device according to claim 6, wherein the output further includes an alarm that activates when the output characteristic is the second characteristic.

8. The portable test device according to claim 7, wherein the alarm is selected from the group consisting of a smoke alarm, a fire alarm, a carbon monoxide detector and any combination thereof.

9. The portable test device according to claim 7, wherein the alarm is communicatively attached to a receiver of a third party service provider.

10. The portable test device according to claim 1, wherein the reference pressure is the environmental pressure outside of the clothes dryer.

11. A method comprising the steps of:

providing a portable test device having an air flow sensor, a tubular member having a first end connected to the air flow sensor and a second end that extends beyond an outer surface of the housing, wherein the tubular member defines a passageway extending between the first end and the second end such that the first end is in fluid communication with atmosphere that surrounds the outer surface of the housing, wherein the tubular member is retractably connected to housing and sensor such that a majority portion of tubular member is contained within housing when the portable test device is not being used and can be extended therefrom beyond the outer surface of the housing and into a working position, wherein the tubular member is a flexible plastic tube;

interfacing the portable test device with a working device having an exhaust passage, wherein the working device is a clothes dryer having: a door, a lint filter and a blower, wherein the interfacing step includes inserting the second end of the tubular member into a clothes drying area of the clothes dryer, upstream from the lint trap, the exhaust passage and the blower;

closing the door of the clothes dryer such that the second end remains within the clothes drying area;

activating the clothes dryer for arrangement in an on condition;

comparing internal pressure within the clothes dryer against an environmental pressure outside of the clothes dryer to identify whether a sufficient vacuum is present within the clothes dryer;

determining an output characteristic when the difference between the internal pressure and the environmental pressure is less than a pre-determined threshold; and providing the output characteristic, wherein the detection occurs without modification of the dryer, wherein the tubular member is adapted to extend through the door when arranged in a closed orientation without materially affecting the operation of the clothes dryer.

12. The method according to claim 11, wherein the output characteristic identifies an abnormal condition when the difference between the pressure outside of the clothes dryer and the pressure in the clothes drying area is at or substantially around a pre-defined threshold difference.

13. The method according to claim 12, wherein the output includes an alarm, and further comprising the steps of:

activating the alarm when the output characteristic identifies an abnormal condition.

14. The method according to claim 13, wherein the step of activating an alarm further comprises the sub-step of:

sounding an audible alarm.

15. The method according to claim 13, wherein the step of activating an alarm further comprises the sub-step of:

sending a communication that signifies the output characteristic.

16. The method according to claim 15, wherein the communication is sent to a third party service provider.

17. The method according to claim 15, wherein the communication is sent to a consumer communication device.

18. The method of detecting an airflow condition in a clothes dryer according to claim 11, wherein the portable test device includes one or more light emitting diodes and wherein the output characteristic of a normal condition and the output characteristic of an abnormal condition are differentiated by an activation of the one or more light emitting diodes.

* * * * *